US007129628B2

(12) United States Patent
Taniwa et al.

(10) Patent No.: US 7,129,628 B2
(45) Date of Patent: Oct. 31, 2006

(54) VELOCITY MODULATION COIL APPARATUS AND CATHODE-RAY TUBE APPARATUS

(75) Inventors: Kenichiro Taniwa, Takatsuki (JP); Akira Satou, Ibaraki (JP); Katsuyo Iwasaki, Nishinomiya (JP)

(73) Assignee: Matsushita Toshiba Picture Display Co., Ltd., Osaka (JP)

( * ) Notice: Subject to any disclaimer, the term of this patent is extended or adjusted under 35 U.S.C. 154(b) by 0 days.

(21) Appl. No.: 11/148,644

(22) Filed: Jun. 9, 2005

(65) Prior Publication Data

US 2005/0275332 A1 Dec. 15, 2005

(30) Foreign Application Priority Data

Jun. 11, 2004 (JP) ..... 2004-174125
Jun. 11, 2004 (JP) ..... 2004-174126

(51) Int. Cl.
*H01J 29/70* (2006.01)

(52) U.S. Cl. ..... 313/440; 335/213; 335/299

(58) Field of Classification Search ..... 313/440; 335/213

See application file for complete search history.

(56) References Cited

U.S. PATENT DOCUMENTS 5,621,287 A 4/1997 Dossot et al.
7,012,360 B1 * 3/2006 Iwasaki et al. ..... 313/477 R
2005/0057694 A1 * 3/2005 Iwasaki ..... 348/719
2005/0225268 A1 * 10/2005 Sakurai et al. ..... 315/368.25

FOREIGN PATENT DOCUMENTS

| | | |
|---|---|---|
| EP | 0 851 456 | 7/1998 |
| EP | 0 901 147 | 4/1999 |
| EP | 1 117 123 | 7/2001 |
| JP | 57-45650 | 10/1982 |
| JP | 6-283113 | 10/1994 |
| JP | 2003-116019 | 4/2003 |
| WO | 00/79560 | 12/2000 |

* cited by examiner

*Primary Examiner*—Ashok Patel
(74) *Attorney, Agent, or Firm*—Hamre, Schumann, Mueller & Larson, P.C.

(57) ABSTRACT

A pair of velocity modulation coils are placed with a horizontal plane including a tube axis interposed therebetween, and a pair of magnetic substances are placed with a vertical plane including a tube axis interposed therebetween. A straight line portion of the velocity modulation coil extending substantially in parallel to the tube axis is placed between the magnetic substance and the tube axis. An interval D between the magnetic substance and the straight line portion is 1 to 3 mm. Assuming that the tube axis is a Z-axis, a size of the velocity modulation coil in a tube axis direction is L, and a position of an end of the velocity modulation coil on a side opposite to a phosphor screen in the tube axis direction is Z=0, a center point of the pair of magnetic substances in the tube axis direction is present in a range of Z=0.2×L to 0.9×L. Consequently, the sensitivity of velocity modulation can be enhanced while suppressing an increase in a driving power with a simple configuration.

9 Claims, 9 Drawing Sheets

VELOCITY MODULATION COIL APPARATUS AND CATHODE-RAY TUBE APPARATUS

BACKGROUND OF THE INVENTION

1. Field of the Invention

The present invention relates to a cathode-ray tube apparatus used in a TV receiver, a computer display, and the like. The present invention also relates to a velocity modulation coil apparatus to be mounted on the cathode-ray tube apparatus.

2. Description of Related Art

As one method for realizing higher image quality in a TV receiver, for example, the enhancement of the edge of an image is known. In order to enhance an edge of an image, a velocity modulation coil is used. The velocity modulation coil is provided at a neck of a cathode-ray tube or in the vicinity thereof, and generates a magnetic field in a vertical direction to modulate the horizontal scanning velocity of an electron beam, thereby enhancing the edge of an image (e.g., see JP 57(1982)-45650 U and JP6(1994)-283113 A).

In the color cathode-ray tube apparatus, along with the increase in a diameter of an electron beam spot on a phosphor screen ascribed to the recent enlargement of a screen, the increase in an anode voltage for higher brightness, or the increased flatness of a front panel, there is a demand for a further higher intensity in the magnetic field for enhancing an edge of an image.

In order to satisfy the above-mentioned demand, a color cathode-ray tube apparatus has been proposed that is capable of increasing the intensity of the magnetic field acting on an electron beam without increasing the amount of a current that flows through a velocity modulation coil and without increasing the winding number of the velocity modulation coil (e.g., see JP 6(1994)-283113 A and JP2003-116019 A).

In the color cathode-ray tube apparatus described in JP 6(1994)-283113 A, a pair of magnetic substances are placed in upper and lower portions of respective electron beam passage apertures of R, G, and B provided at a fifth grid (G5 electrode) of an electron gun housed in a neck, and a pair of velocity modulation coils are placed at positions on an outer circumferential surface of the neck corresponding to the G5 electrode.

In JP 2003-116019 A, a pair of velocity modulation coils and a pair of magnetic substances are placed so as to be opposed to each other in a vertical direction on an outer circumferential surface of a neck. Herein, the magnetic substance is placed in the vicinity of the center of a loop of the velocity modulation coil.

In JP 6(1994)-283113 A and JP 2003-116019 A, due to the above-mentioned configurations, a magnetic flux generated by a pair of velocity modulation coils is collected by a pair of magnetic substances so as to be concentrated in an electron beam passage region. Therefore, the intensity of a magnetic field contributing to the velocity modulation of the electron beam can be increased.

However, in the color cathode-ray tube apparatus described in the above-mentioned JP 57(1982)-45650 U, the velocity modulation coil, and a horizontal deflection coil and a vertical deflection coil are placed so as to be overlapped with each other along the tube axis direction. Therefore, a magnetic field generated by the velocity modulation coil and a deflection magnetic field generated by the horizontal deflection coil and the vertical deflection coil interfere with each other to cause the degradation of image quality (so-called ringing).

Furthermore, in the color cathode-ray tube apparatus described in the above-mentioned JP 6(1994)-283113 A, due to the loss caused by an eddy current generated on the surface of the electrode (G5 electrode) that is a metal component, the intensity of a magnetic field generated in the electron beam passage region in the G5 electrode is low. Thus, even if the magnetic substances are attached to the G5 electrode to allow an originally weak magnetic flux to be collected, a satisfactory increase of the intensity of a magnetic field cannot be expected. That is, in JP 6(1994)-283113 A, the sensitivity of velocity modulation (velocity modulation amount of an electron beam with respect to a current input to the velocity modulation coil) cannot be enhanced sufficiently. Furthermore, the magnetic substances are placed at the G5 electrode constituting the electron gun in the neck, so that the component assembly man-hour increases, resulting in an increase in a cost.

Furthermore, even if the magnetic substance is placed in the vicinity of the center of a loop of the velocity modulation coil as in the above-mentioned JP 2003-116019 A, the magnetic resistance with respect to the magnetic field generated by the velocity modulation coil cannot be reduced sufficiently. Consequently, a sufficient velocity modulation effect cannot be obtained.

On the other hand, a strong magnetic field also can be obtained by increasing the winding number of the velocity modulation coil instead of placing the magnetic substances as in JP 6(1994)-283113 A and JP 2003-116019 A. However, in this case, the impedance of the velocity modulation coil increases, making it necessary to apply a large power to the velocity modulation coil, which leads to an increase in a cost of a driving circuit.

Thus, a procedure of improving the effect of enhancing an edge of an image by the velocity modulation coil without increasing a driving power has not been realized.

SUMMARY OF THE INVENTION

The present invention solves the above-mentioned conventional problems, and its object is to provide a velocity modulation coil apparatus capable of enhancing the sensitivity of velocity modulation while suppressing an increase in a driving power (i.e., an increase in impedance) with a simple configuration. It is another object of the present invention to provide a cathode-ray tube apparatus in which image quality is improved by the enhancement of an edge of an image without excessive cost, owing to such a velocity modulation coil apparatus.

A velocity modulation coil apparatus of the present invention includes a pair of velocity modulation coils for modulating a horizontal deflection velocity of an electron beam emitted from an electron gun, and a pair of magnetic substances, and is provided on an outer circumferential surface of a funnel of a cathode-ray tube. The pair of velocity modulation coils are placed with a horizontal plane, including a tube axis of the cathode-ray tube, interposed therebetween, and the pair of magnetic substances are placed with a vertical plane, including the tube axis of the cathode-ray tube, interposed therebetween. The velocity modulation coil includes a straight line portion extending substantially in parallel to the tube axis of the cathode-ray tube, and the straight line portion is placed between the magnetic substance and the tube axis of the cathode-ray tube. An interval D between the magnetic substance and the straight line portion is 1 to 3 mm. Assuming that the tube axis of the cathode-ray tube is a Z-axis, a position of an end of the velocity modulation coil on a side opposite to a phosphor screen in a tube axis direction is Z=0, and a position of an end of the velocity modulation coil on a phosphor screen side in the tube axis direction is Z=L, a coordinate $Z_M$ at a center point of the magnetic substance in the tube axis direction satisfies a relationship: $0.2\times L \leqq Z_M \leqq 0.9\times L$.

Furthermore, a cathode-ray tube apparatus of the present invention includes: a cathode-ray tube including a panel with a phosphor screen formed on an inner surface, a funnel connected to the panel, and an electron gun housed in a neck of the funnel; a horizontal deflection coil and a vertical deflection coil provided on an outer circumferential surface of the funnel, for deflecting an electron beam emitted from the electron gun in horizontal and vertical directions so as to allow the electron beam to scan the phosphor screen; and a velocity modulation coil apparatus provided on the outer circumferential surface of the funnel. The velocity modulation coil apparatus is the above-mentioned velocity modulation coil apparatus of the present invention.

DETAILED DESCRIPTION OF THE INVENTION

Figure 1:
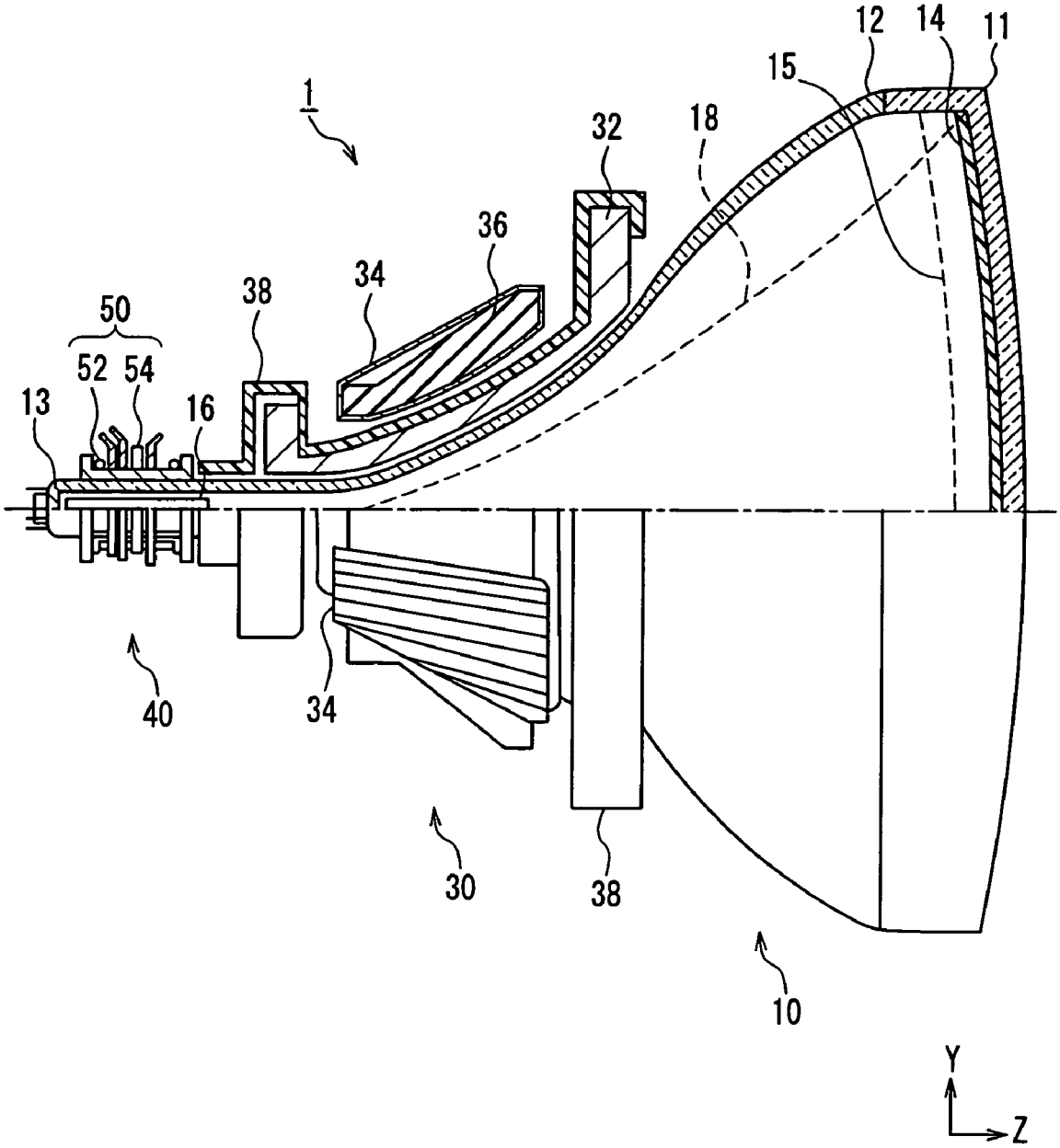
FIG. 1 is a partial cross-sectional view showing a schematic configuration of a color cathode-ray tube apparatus according to one embodiment of the present invention.

According to the present invention, the magnetic resistance with respect to a magnetic flux generated by a pair of velocity modulation coils is reduced by a pair of magnetic substances. Therefore, the density of the magnetic flux in an electron beam passage region in the neck can be increased. Consequently, the sensitivity of velocity modulation can be enhanced without increasing a driving power, so that image quality can be improved by the enhancement of an edge.

In the present invention, it is preferable that an angle θ of an open portion between the pair of magnetic substances with respect to the tube axis of the cathode-ray tube is 50° to 90°. According to this configuration, the sensitivity of velocity modulation can be enhanced further, while the new occurrence of an image distortion and a misconvergence caused by the presence of the pair of magnetic substances is being reduced.

It is preferable that a length H of the magnetic substance in the tube axis direction is 2 to 5 mm. When the length H of the magnetic substance in the tube axis direction is larger than this range, a cost increases and the size of the cathode-ray tube apparatus in the tube axis direction increases. When the length H of the magnetic substance in the tube axis direction is smaller than this range, the mechanical strength of the magnetic substance decreases.

Assuming that a length of the magnetic substance in the tube axis direction is H, and a thickness of the magnetic substance along a horizontal axis passing through the tube axis is T, it is preferable that a relationship: $T/H \geqq 1$ is satisfied. This further can increase the density of a magnetic flux in an electron beam passage region in the neck.

It is preferable that the magnetic substance is a sintered body of at least one kind of magnetic powder selected from the group consisting of Mg—Zn ferrite, Mn—Zn ferrite, and Ni—Zn ferrite. This provides a magnetic substance with a high magnetic permeability, so that the sensitivity of velocity modulation can be enhanced.

Alternatively, the magnetic substance may be made of resin in which at least one kind of magnetic powder selected from the group consisting of Mg—Zn ferrite, Mn—Zn ferrite, and Ni—Zn ferrite is mixed. This provides a magnetic substance at a low cost. Furthermore, a pair of magnetic substances can be placed as a spacer between magnets forming a Convergence and Purity Unit (CPU), so that the size of the CPU in the tube axis direction can be shortened.

It is preferable that the pair of velocity modulation coils are placed on the neck side with respect to the horizontal deflection coil and the vertical deflection coil. When the pair of velocity modulation coils are placed so as to be overlapped with the horizontal deflection coil and the vertical deflection coil in the tube axis direction, a magnetic flux generated by the velocity modulation coils and a magnetic flux generated by the horizontal and vertical deflection coils interfere with each other to cause ringing, which degrades image quality and decreases the sensitivity of velocity modulation.

It is preferable that a position of the pair of magnetic substances in a tube axis direction is matched with a position in the tube axis direction of a gap between two electrodes of the electron gun, which are spaced from each other in the tube axis direction and form a main lens. This can prevent the magnetic field generated by the pair of velocity modulation coils from being consumed to decrease the sensitivity of velocity modulation, due to the eddy current loss caused by the electrodes.

Hereinafter, the present invention will be described with reference to the drawings.

FIG. 1 is a partial cross-sectional view showing a schematic configuration of a color cathode-ray tube apparatus 1 according to one embodiment of the present invention. For convenience of the following description, it is assumed that a tube axis is a Z-axis, a horizontal (screen long side direction) axis is an X-axis, and a vertical (screen short side direction) axis is a Y-axis. The X-axis and the Y-axis are orthogonal to each other and the Z-axis. In FIG. 1, a cross-sectional view is shown on an upper side from the Z-axis, and an external appearance view is shown on a lower side therefrom.

As shown in FIG. 1, the color cathode-ray tube apparatus 1 is composed of a color cathode-ray tube 10, a deflection yoke 30, a CPU 40, a velocity modulation coil apparatus 50, and the like.

The color cathode-ray tube 10 includes a glass bulb formed by connecting a face panel 11 to a funnel 12, and a shadow mask 15 and an in-line type electron gun (hereinafter, merely referred to as an "electron gun") 16 housed inside the glass bulb.

On an inner surface of the face panel 11, a phosphor screen 14 is formed in which respective phosphor dots (or phosphor stripes) of red, green, and blue are arranged periodically. The shadow mask 15 is provided at a substantially constant spacing from the phosphor screen 14. A number of electron beam passage apertures are provided in the shadow mask 15. Three electron beams 18 emitted from the electron gun 16 (three electron beams are arranged in a line parallel to the X-axis, so that only one electron beam on the front side is shown in FIG. 1) pass through the electron beam passage apertures provided in the shadow mask 15 to strike desired phosphors.

The deflection yoke 30 is provided on an outer circumferential surface of the funnel 12. The deflection yoke 30 includes a saddle-type horizontal deflection coil 32 and a toroidal vertical deflection coil 34, and the vertical deflection coil 34 is wound around a ferrite core 36. The three electron beams emitted from the electron gun 16 are deflected in horizontal and vertical directions by a horizontal deflection magnetic field generated by the horizontal deflection coil 32 and a vertical deflection magnetic field generated by the vertical deflection coil 34, and scan the phosphor screen 13 by a raster scan system. A resin frame 38 is provided between the horizontal deflection coil 32 and the vertical deflection coil 34. The resin frame 38 maintains an electrical insulation state between the horizontal deflection coil 32 and the vertical deflection coil 34, and supports both the deflection coils 32, 34.

Figure 2:
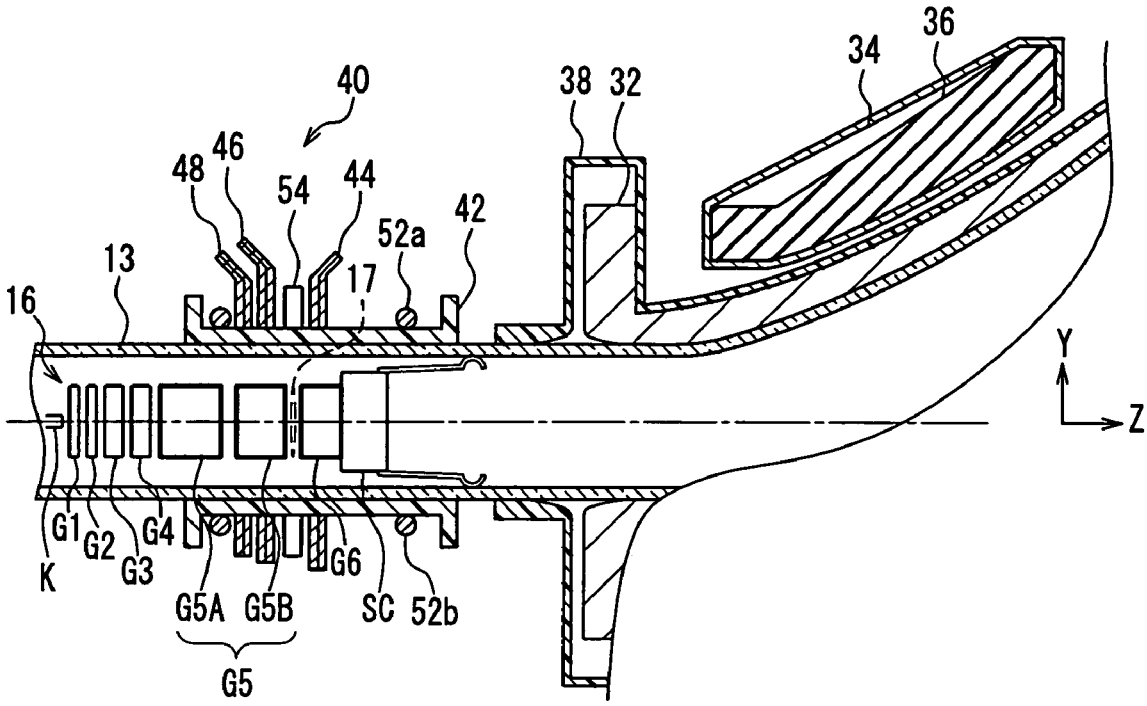
FIG. 2 is an enlarged cross-sectional view of a neck and the vicinity thereof in the color cathode-ray tube apparatus according to one embodiment of the present invention.

FIG. 2 is an enlarged cross-sectional view showing the vicinity of the neck 13 in a cylindrical shape of the funnel 12.

The electron gun 16 is housed in the neck 13. The electron gun 16 is composed of three cathodes K (only one cathode on the front side among the three cathodes arranged in a line along the X-axis is shown in FIG. 2) which are to be heated separately by three heaters (not shown), respective electrodes G1, G2, G3, G4, G5A, G5B, and G6 successively placed at a predetermined interval in a direction from the cathodes K toward the phosphor screen 14 along the tube axis, a shield cup SC attached to the electrode G6, and the like. In the electron gun 16, a main lens 17 is formed between the electrode G5B and the electrode G6. The main lens 17 collects the respective electron beams 18 onto the phosphor screen 14.

The CPU 40 is placed on the outer circumferential surface of the neck 13 so as to be overlapped with the electron gun 16 in the tube axis direction, and adjusts the static convergence and purity of the electron beams 18. The CPU 40 includes a purity (color purification) magnet 44, a quadrupole magnet 46 and a hexapole magnet 48 attached to a resin frame 42 having a cylindrical shape. The purity magnet 44, the quadrupole magnet 46, and the hexapole magnet 48 respectively are composed of one set of two magnets having an annular shape.

Figure 3A:
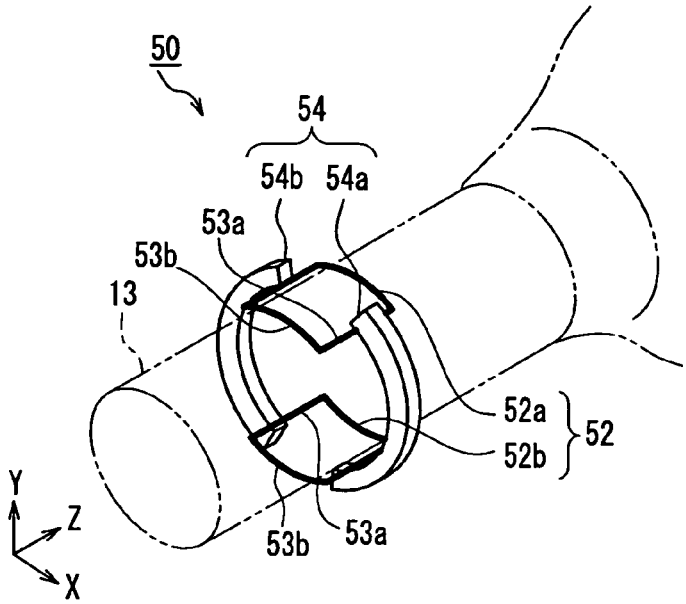
FIG. 3A is a schematic perspective view of a velocity modulation coil apparatus according to one embodiment of the present invention.
Figure 3B:
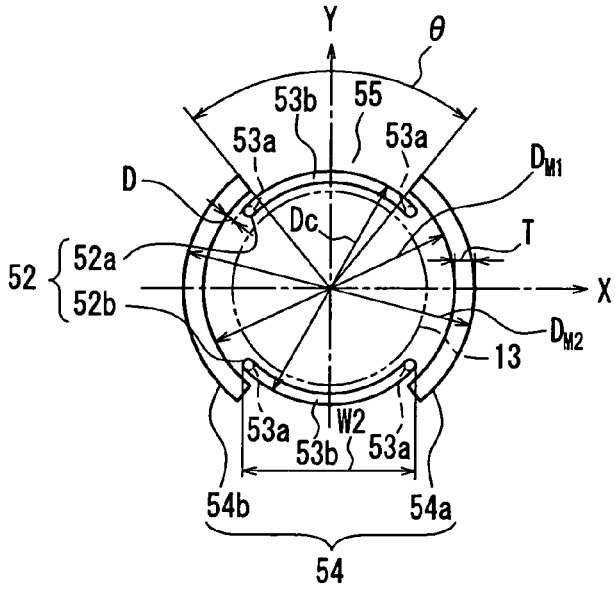
FIG. 3B is a front view of the velocity modulation coil apparatus according to one embodiment of the present invention, seen along a tube axis.
Figure 3C:
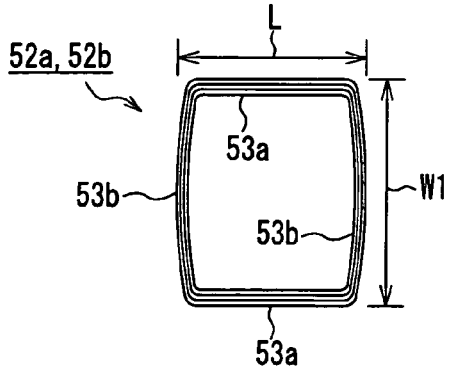
FIG. 3C is a developed view of a velocity-modulation coil.

FIG. 3A is a schematic perspective view of a velocity modulation coil apparatus 50 according to one embodiment of the present invention. FIG. 3B is a front view of the velocity modulation coil apparatus 50, seen along the tube axis. FIG. 3C is a developed view of a velocity modulation coil.

The velocity modulation coil apparatus 50 includes a pair of velocity modulation coils 52*a*, 52*b* placed with a horizontal plane (XZ-plane) including the tube axis interposed therebetween, and a pair of magnetic substances 54*a*, 54*b* placed with a vertical plane (YZ-plane) including the tube axis interposed therebetween. In the following description, the pair of velocity modulation coils 52*a*, 52*b* may be referred to collectively as a velocity modulation coil 52, and the pair of magnetic substances 54*a*, 54*b* may be referred to collectively as a magnetic substance 54.

The velocity modulation coils 52*a*, 52*b* are attached to the resin frame 42 of the CPU 40 so as to be substantially symmetrical with respect to the Z-axis. More specifically, the pair of velocity modulation coils 52*a*, 52*b* are integrally attached to the CPU 40. The pair of velocity modulation coils 52*a*, 52*b* are supplied with a current in accordance with a velocity modulation signal obtained by differentiating a video signal.

In a state developed on a plane, the velocity modulation coils 52*a*, 52*b* are both loop coils in a substantially square shape. Among four sides constituting the loop coil, a pair of sides (straight line portions) 53*a* opposed to each other are placed so as to be substantially parallel to the Z-axis, and the remaining pair of sides (curved portions) 53*b* opposed to each other are placed substantially along an XY-plane in such a manner as to be curved in a substantially arc shape along the curvature of an outer circumferential surface of the resin frame 42.

In one example, the velocity modulation coils 52*a*, 52*b* were formed by winding a copper wire coated with a polyurethane coating (wire diameter: 0.4 [mm]) four turns. In a state where the velocity modulation coils 52*a*, 52*b* were developed on a plane as shown in FIG. 3C, a size L along the straight line portion 53*a* was set to be 25 [mm], and a width (in a state developed on a plane) W1 along the curved portion 53*b* was set to be 35 [mm]. When the pair of velocity modulation coils 52*a*, 52*b* were attached to the resin frame 42 with the curved portions 53*b* bent in a substantially arc shape, the pair of velocity modulation coils 52*a*, 52*b* had an outer diameter $D_C$ of ϕ33.5 [mm], and a size W2 in the X-axis direction of about 30 [mm]. Herein, the outer diameter $D_C$ of the pair of velocity modulation coils 52*a*, 52*b* refers to a diameter of a virtual cylindrical surface circumscribing the velocity modulation coils 52*a*, 52*b*.

Both of the magnetic substances 54*a*, 54*b* have a substantially arc shape, and are attached to the resin frame 42 at positions where they are substantially symmetrical with respect to the Z-axis, and overlapped with the pair of velocity modulation coils 52*a*, 52*b* along the Z-axis direction. As shown in FIG. 3B, each straight line portion 53*a* of the velocity modulation coils 52*a*, 52*b* is placed between the magnetic substance 54*a* (or 54*b*) and the Z-axis. More specifically, the arc lengths and attachment positions of the magnetic substances 54*a*, 54*b* are set in such a manner that a straight line passing through the Z-axis and the straight line portion 53*a* and being vertical to the Z-axis crosses the magnetic substance 54*a* (or 54*b*). Consequently, the ratio at which the pair of magnetic substances 54*a*, 54*b* occupy a magnetic path of a magnetic flux generated by the pair of velocity modulation coils 52*a*, 52*b* increases, so that the magnetic resistance is reduced, which can enhance the sensitivity of velocity modulation.

In one example, the magnetic substances 54*a*, 54*b* were made of a sintered body of magnetic powder of Mg—Zn ferrite, and had a specific resistance of $1\times10^5$ [Ω·m]. When attached to the resin frame 42, the pair of magnetic substances 54*a*, 54*b* had an inner diameter $D_{M1}$ of ϕ36.8 [mm], an outer diameter $D_{M2}$ of ϕ46.8 [mm], a thickness T along the X-axis of 5 [mm], and a length H in the Z-axis direction (see FIG. 7) of 2.5 [mm]. Furthermore, an angle θ (dividing angle) of the open portion 55 between the pair of magnetic substances 54*a*, 54*b* with respect to the Z-axis was set to be 70°. An interval D in the XY-plane between the magnetic substance 54*a* (or 54*b*) and the straight line portion 53*a* of the velocity modulation coil 52*a* (or 52*b*) was 1.65 [mm]. In the Z-axis direction, the pair of magnetic substances 54*a*, 54*b* were placed at a substantially symmetrically relative to the pair of velocity modulation coils 52*a*, 52*b*.

The above-mentioned velocity modulation coil apparatus 50 can increase the density of a magnetic flux generated by the pair of velocity modulation coils 52*a*, 52*b* in the neck 13, thereby allowing the magnetic flux to act on the electron beams 18.

Figure 4A:
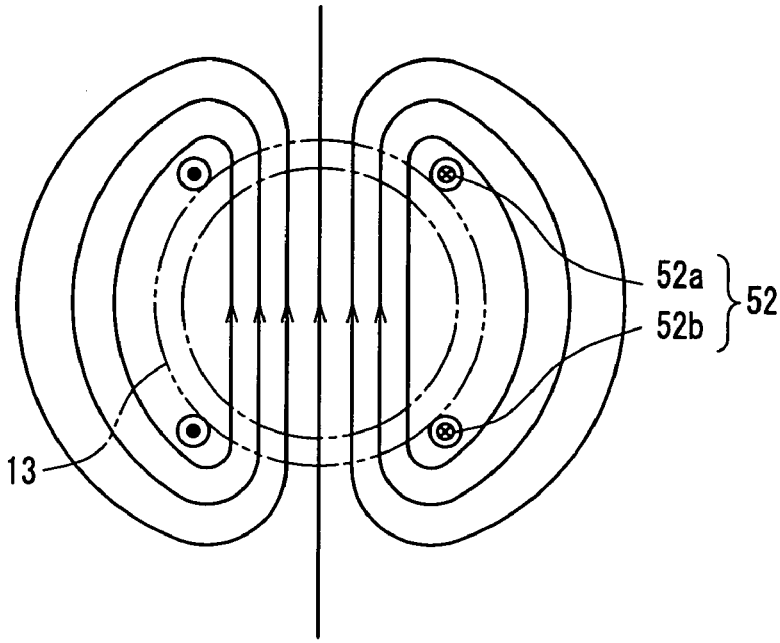
FIG. 4A shows the state of a magnetic flux generated by a pair of velocity modulation coils in the case where a pair of magnetic substances are not provided.
Figure 4B:
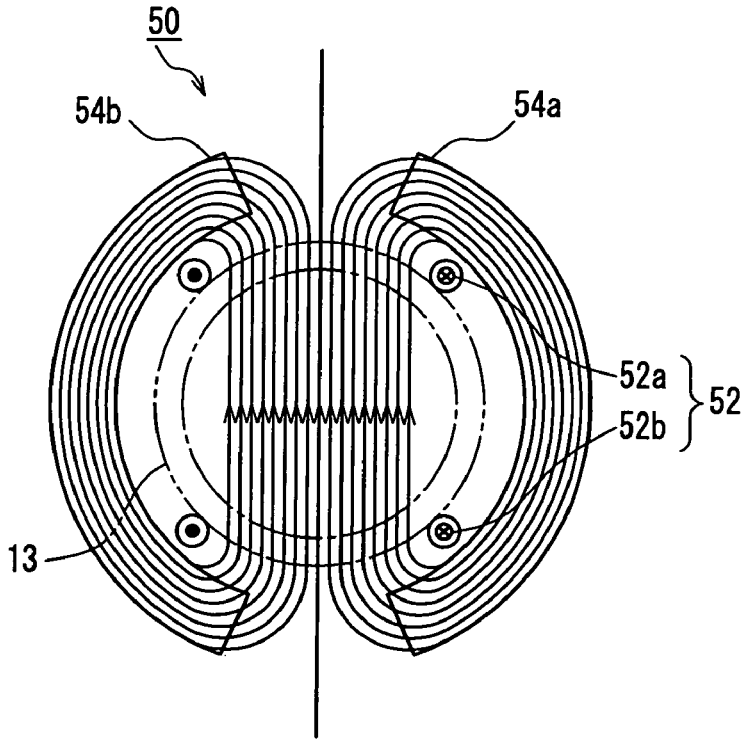
FIG. 4B shows the state of a magnetic flux generated by a pair of velocity modulation coils in the velocity modulation coil apparatus of the present invention in which a pair of magnetic substances are provided.

This will be described with reference to FIGS. 4A and 4B. FIG. 4A shows the state of a magnetic flux generated by the pair of velocity modulation coils 52*a*, 52*b* in the case where the pair of magnetic substances 54*a*, 54*b* are not provided. FIG. 4B shows the state of a magnetic flux generated by the pair of velocity modulation coils 52*a*, 52*b* in the case where the pair of magnetic substances 54*a*, 54*b* are provided. FIGS. 4A and 4B respectively show a magnetic flux in a plane passing through the straight line portion 53*a* of the velocity modulation coils 52*a*, 52*b* and being vertical to the Z-axis.

As is understood from FIGS. 4A and 4B, when the pair of magnetic substances 54*a*, 54*b* are provided, a magnetic flux passes through the pair of magnetic substances 54*a*, 54*b* in a portion where the pair of magnetic substances 54*a*, 54*b* are present in a magnetic path outside of the neck 13, so that the magnetic resistance can be reduced. Thus, in a region which the electron beams pass through in the neck 13, the density of a magnetic flux generated by the pair of velocity modulation coils 52*a*, 52*b* is increased.

Next, a relationship between the interval D between the magnetic substance 54*a* (or 54*b*) and the straight line portion 53*a* of the velocity modulation coil 52*a* (or 52*b*) in the XY-plane orthogonal to the tube axis, and the sensitivity of velocity modulation will be described with reference to FIG. 5.

Figure 5:
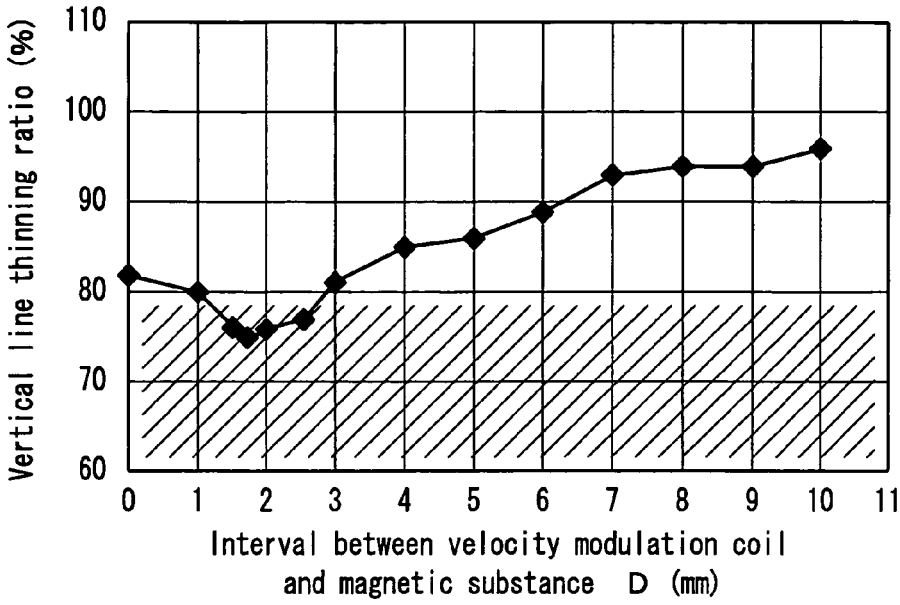
FIG. 5 shows a relationship between an interval D between the velocity modulation coil and the magnetic substance, and a vertical line thinning ratio of a screen.

In FIG. 5, a horizontal axis represents the above-mentioned interval D, and a vertical axis represents a vertical line thinning ratio on a screen of the cathode-ray tube apparatus. Herein, the vertical line thinning ratio was obtained as follows. A cross-hatching pattern was displayed with an NTSC signal on a screen while the pair of velocity modulation coils 52*a*, 52*b* were being driven with a driving power of 4.0 W using the velocity modulation coil apparatus in the above-mentioned example. A vertical line width A in the absence of the pair of magnetic substances 54*a*, 54*b* and a vertical line width B in the presence of the pair of magnetic substances 54*a*, 54*b* were obtained, and (B/A)×100[%] was set to be a vertical line thinning ratio. The vertical line thinning ratio was obtained by changing the interval D variously. When the sensitivity of velocity modulation is enhanced, a vertical line width becomes narrow, and an edge is enhanced, so that the sharpness of image quality is improved. Generally, when the vertical line thinning ratio is 80% or less (shaded region in FIG. 5), the improvement effect of image quality by velocity modulation is considered to be recognizable visually.

The following is understood from FIG. 5. Image quality can be improved by providing the pair of magnetic substances 54*a*, 54*b*. In particular, when the interval D is 1 to 3 mm, the vertical line thinning ratio becomes 80% or less, and the sensitivity of velocity modulation is enhanced, whereby a satisfactory image is obtained.

Next, a relationship between the relative position in the tube axis direction between the pair of magnetic substances 54*a*, 54*b* and the pair of velocity modulation coils 52*a*, 52*b*, and the sensitivity of velocity modulation will be described with reference to FIG. 6.

Figure 6:
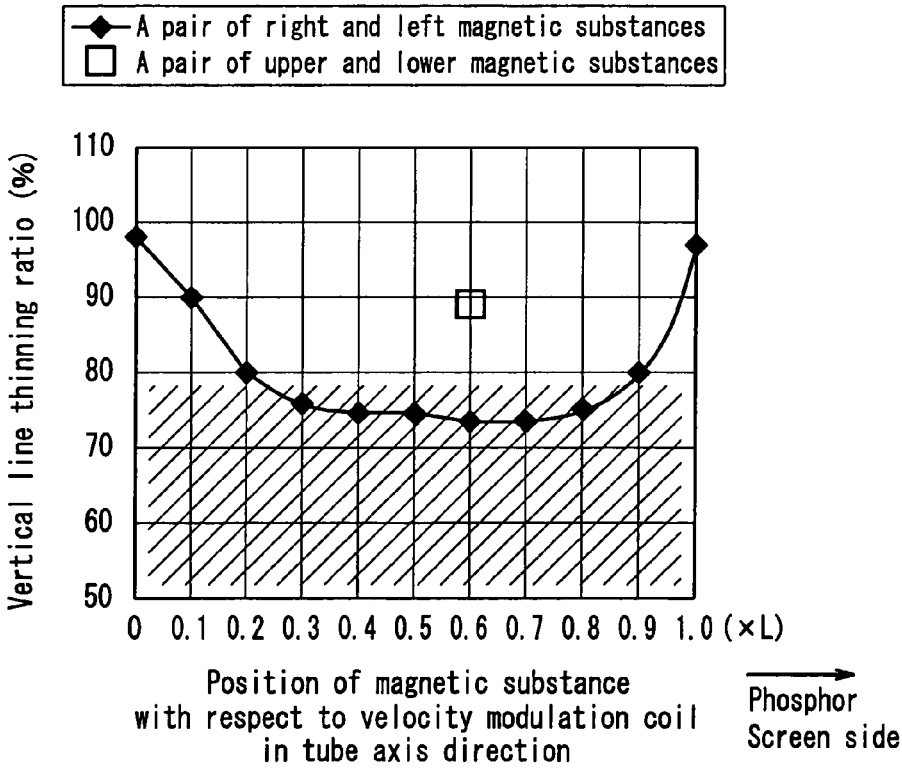
FIG. 6 shows a relationship between a relative position of the magnetic substance with respect to the velocity modulation coil in a tube axis direction, and a vertical line thinning ratio of a screen.

In FIG. 6, a vertical axis represents a vertical line thinning ratio defined in a similar manner to that of FIG. 5. A horizontal axis represents the relative position in the tube axis direction of the pair of magnetic substances 54*a*, 54*b* with respect to the pair of velocity modulation coils 52*a*, 52*b*, which is defined as follows.

Figure 7:
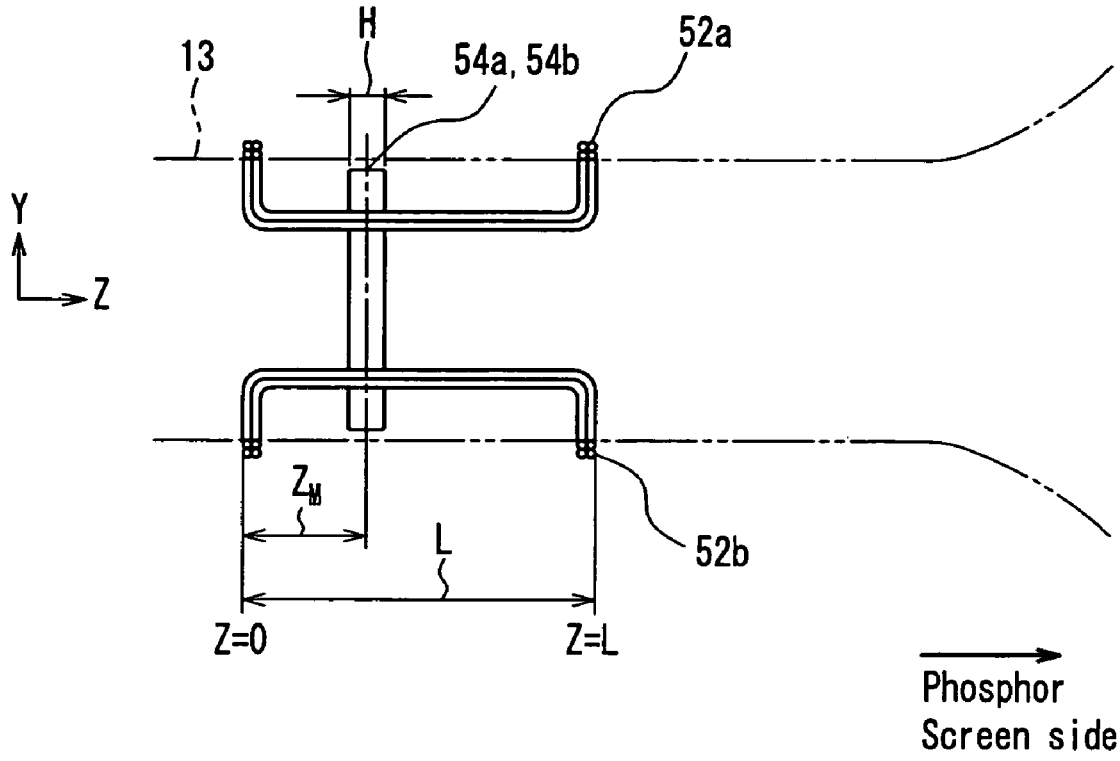
FIG. 7 is a side view illustrating the definition of the relative position of the magnetic substance with respect to the velocity modulation coil in the tube axis direction in FIG. 6.

As shown in FIG. 7, it is assumed that a size of the velocity modulation coils 52*a*, 52*b* in the Z-axis direction is L, a position of an end of the velocity modulation coils 52*a*, 52*b* on a side opposite to the phosphor screen in the Z-axis direction is an origin (Z=0), a position of an end of the velocity modulation coils 52*a*, 52*b* on a phosphor screen side is Z=L, and a phosphor screen side is a positive direction of the Z-axis. The relative position in the tube axis direction of the pair of magnetic substances 54*a*, 54*b* with respect to the pair of velocity modulation coils 52*a*, 52*b* is obtained by expressing a Z-axis coordinate $Z_M$ at a center point in the Z-axis direction of the magnetic substances 54*a*, 54*b* having a length H in the Z-axis direction, using L.

The vertical line thinning ratio was obtained by changing the above-mentioned relative position variously while driving the pair of velocity modulation coils 52*a*, 52*b* with a driving power of 4.0 W, using the velocity modulation coil apparatus in the above-mentioned example ("a pair of right and left magnetic substances" in FIG. 6). Similarly, the vertical line thinning ratio was obtained by rotating the pair of magnetic substances 54*a*, 54*b* by 90° around the Z-axis at a position of $Z_M$=0.6=L so as to allow them to be opposed to each other in the vertical direction ("a pair of upper and lower magnetic substances" in FIG. 6).

It is understood from FIG. 6 that, when $Z_M$ referring to the relative position in the tube axis direction of the pair of magnetic substances 54*a*, 54*b* with respect to the pair of velocity modulation coils 52*a*, 52*b* satisfies a relationship: $0.2\times L \leqq Z_M \leqq 0.9\times L$, the vertical line thinning ratio becomes 80% or less (shaded region in FIG. 6), and the sensitivity of velocity modulation is enhanced, whereby a satisfactory image is obtained. Even when the pair of magnetic substances 54*a*, 54*b* are placed in this range, in the case where they are placed so as to be opposed to each other in the vertical direction, the effect of enhancing the sensitivity of velocity modulation decreases.

Next, a relationship between the angle θ of the open portion 55 between the pair of magnetic substances 54*a*, 54*b* with respect to the tube axis, and the sensitivity of velocity modulation will be described with reference to FIG. 8.

Figure 8:
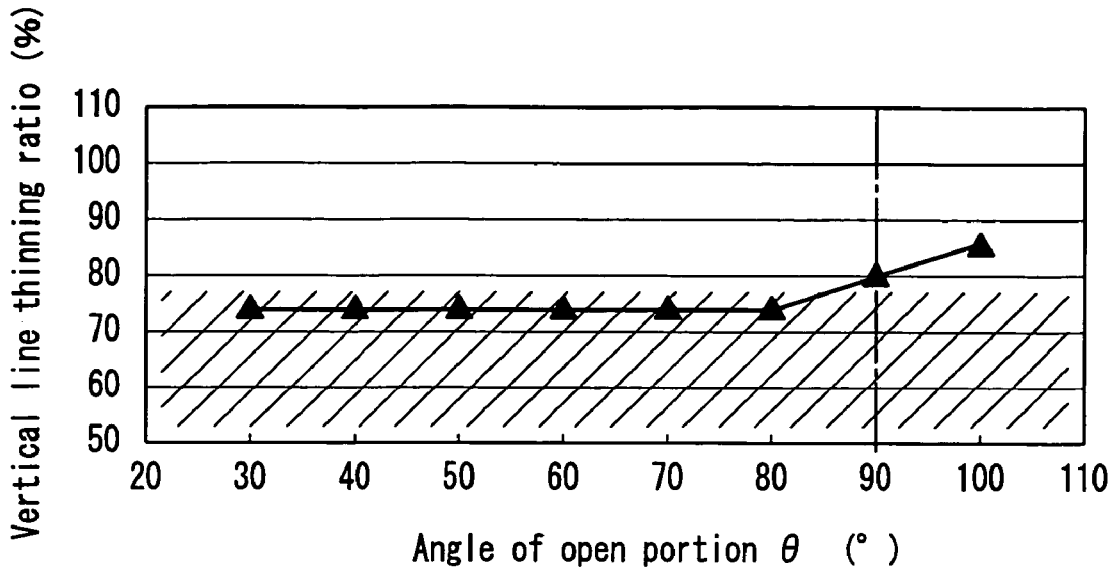
FIG. 8 shows a relationship between an angle θ of an open portion between a pair of magnetic substances with respect to a tube axis, and a vertical line thinning ratio of a screen.

In FIG. 8, a horizontal axis represents the above-mentioned angle θ, and a vertical axis represents a vertical line thinning ratio on a screen of the cathode-ray tube apparatus. Herein, the vertical line thinning ratio was obtained as follows. A cross-hatching pattern was displayed with an NTSC signal on a screen while the pair of velocity modulation coils 52*a*, 52*b* were being driven with a driving power of 4.0 W using the velocity modulation coil apparatus in the above-mentioned example. A vertical line width C in the absence of the pair of magnetic substances 54*a*, 54*b* and a vertical line width E in the presence of the pair of magnetic substances 54*a*, 54*b* were obtained, and (E/C)×100[%] was set to be a vertical line thinning ratio. The vertical line thinning ratio was obtained by changing the angle θ variously. When the sensitivity of velocity modulation is enhanced, a vertical line width becomes narrow, and an edge is enhanced, so that the sharpness of image quality is improved. Generally, when the vertical line thinning ratio is 80% or less (shaded region in FIG. 8), the improvement effect of image quality by velocity modulation is considered to be recognizable visually.

The following is understood from FIG. 8. Image quality can be improved by providing the pair of magnetic substances 54*a*, 54*b*. In particular, when the angle θ is 90° or less, the vertical line thinning ratio becomes 80% or less, and the sensitivity of velocity modulation is enhanced, whereby a satisfactory image is obtained.

Next, a relationship between the angle θ of the open portion 55 between the pair of magnetic substances 54*a*, 54*b* with respect to the tube axis, and the T/B distortion will be described with reference to FIG. 9.

Figure 9:
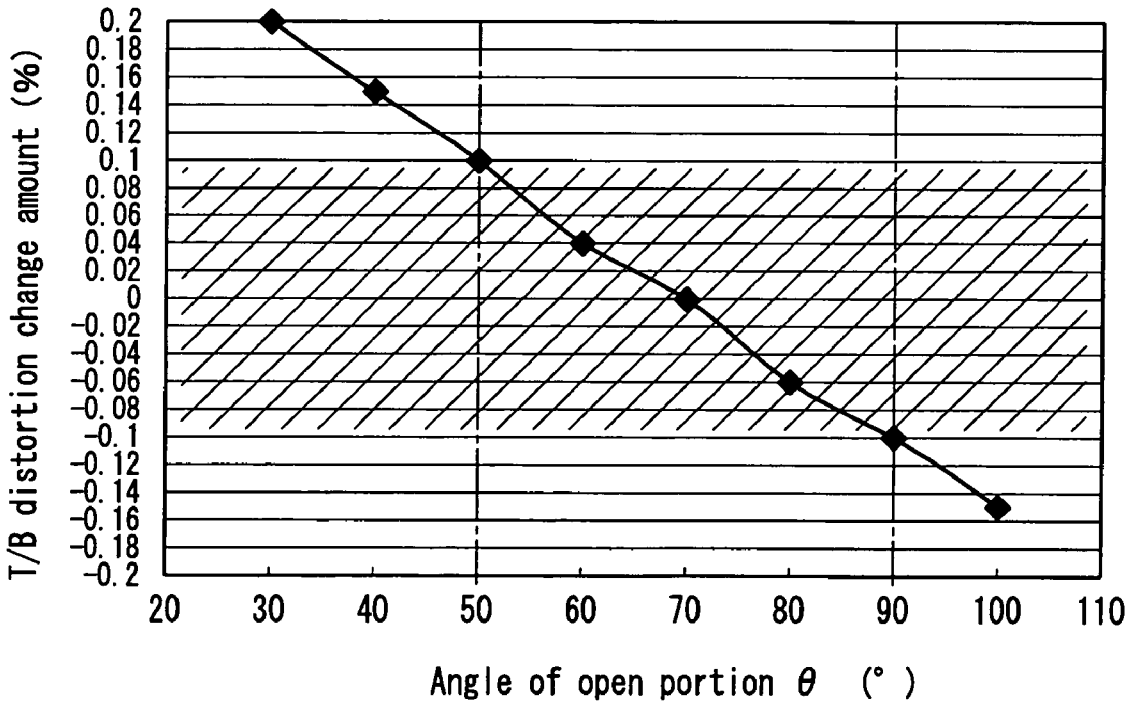
FIG. 9 shows a relationship between an angle θ of an open portion between a pair of magnetic substances with respect to a tube axis, and a T/B distortion change amount of a screen.

In FIG. 9, a horizontal axis represents the above-mentioned angle θ, and a vertical axis represents a T/B distortion change amount. The T/B distortion refers to a pin-cushion distortion of rasters in upper and lower portions of a screen, which is a kind of raster distortion. The T/B distortion change amount was obtained as follows. A cross-hatching pattern was displayed with an NTSC signal on a screen while the pair of velocity modulation coils 52*a*, 52*b* were being driven with a driving power of 4.0 W using the velocity modulation coil apparatus in the above-mentioned example. A T/B distortion F [%] in the absence of the pair of magnetic substances 54*a*, 54*b* and a T/B distortion G [%] in the presence of the pair of magnetic substances 54*a*, 54*b* were obtained, and G–F [%] was set to be a T/B distortion change amount. The T/B distortion change amount was obtained by changing the angle θ variously. The T/B distortion was measured in accordance with a pin-cushion distortion test under EIAJ ED-2101B "Braun tube provided with a deflection yoke test method" (Electronic Industries Association of Japan). Generally, when the T/B distortion changes by 0.1[%] or more, a change in an image distortion is considered to be recognizable visually.

The following is understood from FIG. 9. If the angle θ is in a range of 50° to 90° (shaded region in FIG. 9), an absolute value of a T/B distortion change amount depending upon the presence/absence of the pair of magnetic substances 54*a*, 54*b* is 0.1[%] or less, and hence, a new image distortion hardly occurs due to the presence of the pair of magnetic substances 54*a*, 54*b*.

Next, a relationship between the angle θ of the open portion 55 between the pair of magnetic substances 54*a*, 54*b* with respect to the tube axis and the VCR will be described with reference to FIG. 10.

Figure 10:
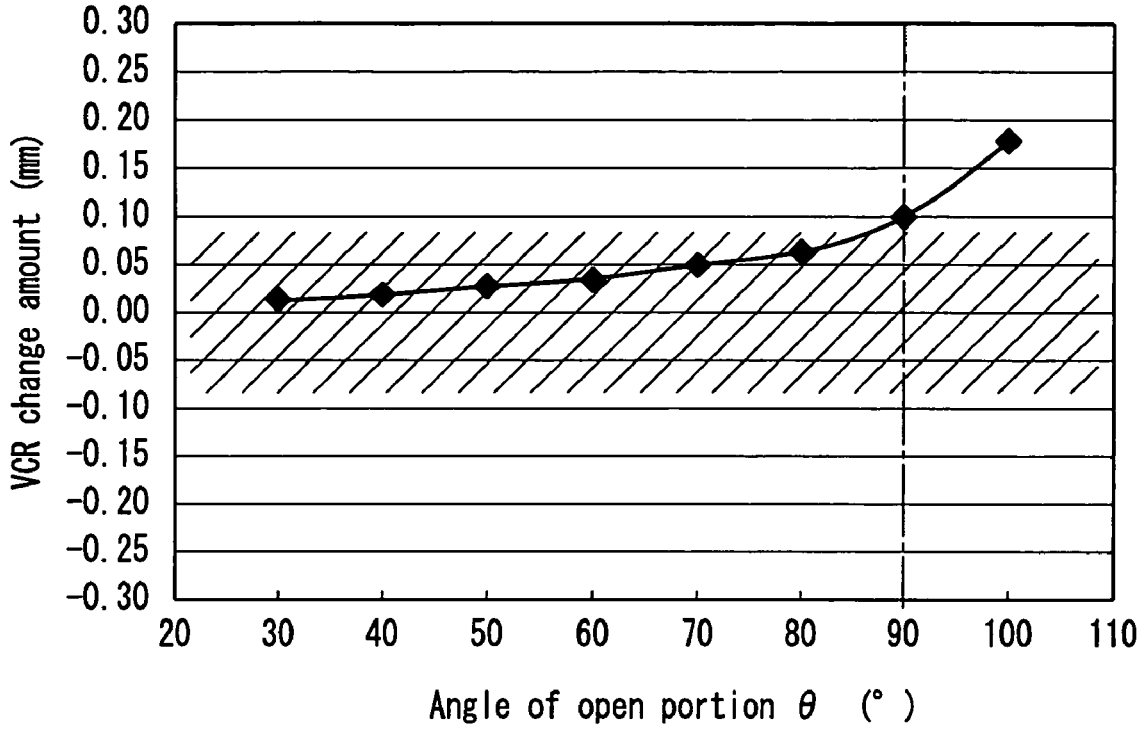
FIG. 10 shows a relationship between an angle θ of an open portion between a pair of magnetic substances with respect to a tube axis, and a VCR change amount of a screen.

In FIG. 10, a horizontal axis represents the above-mentioned angle θ, and a vertical axis represents a VCR change amount. The VCR refers to a misconvergence in the Y-axis direction between both side beams and a center beam at a crossing point (Y-axis end) between the Y-axis and the circumferential edge of a screen. The VCR change amount was obtained as follows. A cross-hatching pattern was displayed with an NTSC signal on a screen while the pair of velocity modulation coils 52*a*, 52*b* were being driven with a driving power of 4.0 W using the velocity modulation coil apparatus in the above-mentioned example. A VCR value H [mm] in the absence of the pair of magnetic substances 54*a*, 54*b* and a VCR value J [mm] in the presence of the pair of magnetic substances 54*a*, 54*b* were obtained, and J–H [mm] was set to be a VCR change amount. The VCR change amount was obtained by changing the angle θ variously. The VCR was measured in accordance with a convergence test under EIAJ ED-2101B "Braun tube provided with a deflection yoke test method" (Electronic Industries Association of Japan). Generally, when the VCR changes by 0.1 [mm] or more, the change in convergence is considered to be recognizable visually.

The following is understood from FIG. 10. When the angle θ is 90° or less (shaded region in FIG. 10), the absolute value of the VCR change amount depending upon the presence/absence of the pair of magnetic substances 54*a*, 54*b* is 0.1 [mm] or less, and a new misconvergence hardly occurs due to the presence of the pair of magnetic substances 54*a*, 54*b*.

It is understood from FIGS. 8 to 10 that, when the angle θ is 50° to 90°, the sensitivity of velocity modulation is enhanced, and image quality can be improved by the enhancement of an edge, without allowing an image distortion and a misconvergence to occur newly As the length H of the magnetic substances 54*a*, 54*b* in the tube axis direction becomes larger, the effect of increasing the density of a magnetic flux increases. However, the increase in a material cost of a magnetic substance and the enlargement of a mold lead to an increase in a cost. Furthermore, the size in the tube axis direction of the CPU 40 on which the magnetic substances 54*a*, 54*b* are to be mounted also increases, which leads to an increase in a material cost of the CPU 40 and a decrease in molding yield of the resin frame 42. Consequently, a cost increases greatly as a whole. Thus, it is preferable that the upper limit of the length H is about 5 mm. On the contrary, when the length H of the magnetic substances 54*a*, 54*b* in the tube axis direction becomes smaller than 2 mm, the mechanical strength decreases, so that the magnetic substances 54*a*, 54*b* tend to be broken by a tightening load (e.g., 49 N or more) of a screw-type fixing component for fixing each magnet, to be placed on a side of the CPU 40 opposite to the phosphor screen. Accordingly, it is preferable that the length H of the magnetic substances 54*a*, 54*b* in the tube axis direction preferably is in a range of 2 mm to 5 mm. This can enhance the sharpness of image quality at a low cost.

Assuming that the length of the magnetic substances 54*a*, 54*b* in the tube axis direction is H, and the thickness of the magnetic substances 54*a*, 54*b* along the horizontal axis passing through the tube axis is T, it is preferable that a relationship: $T/H \geqq 1$ is satisfied. As the thickness T is larger with respect to the length H, the density of a magnetic flux in the electron beam passage region in the neck can be increased further.

The present invention is not limited to the above-mentioned embodiment and example, and can be altered variously as follows.

Figure 11:
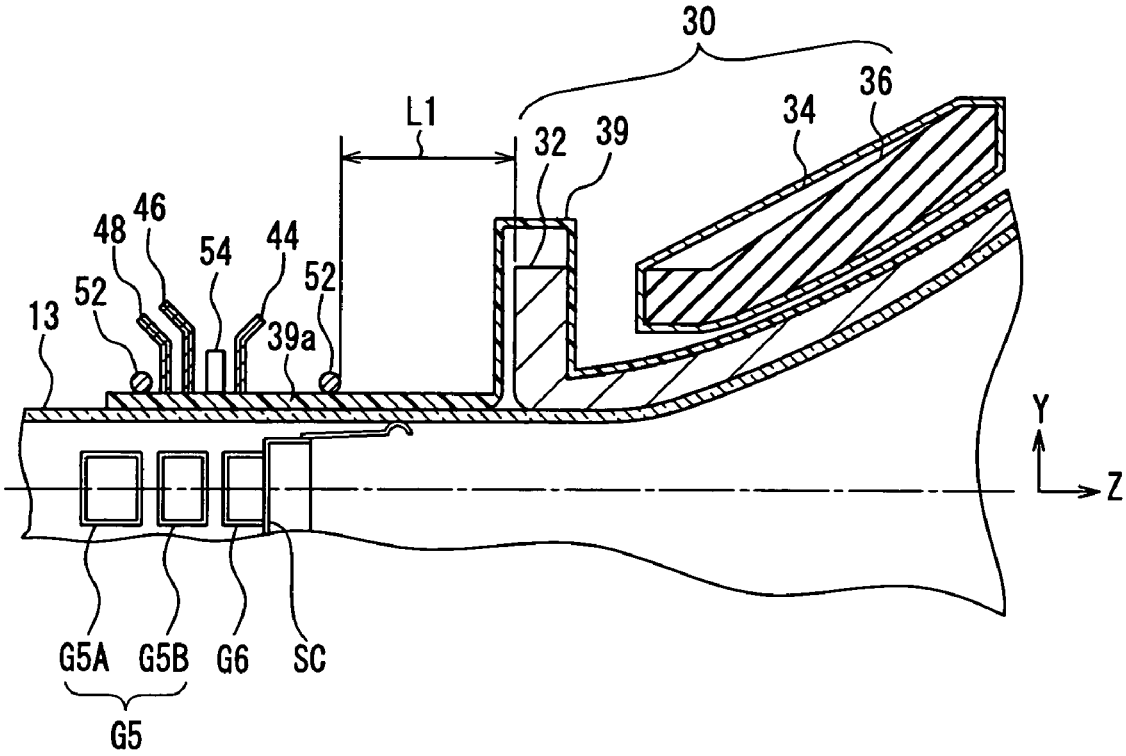
FIG. 11 is an enlarged cross-sectional view of a neck and the vicinity thereof in a color cathode-ray tube apparatus according to another embodiment of the present invention.

(1) For example, in the above-mentioned embodiment, the velocity modulation coil 52 and the magnetic substance 54 are attached to the resin frame 42 of the CPU 40. The present invention is not limited thereto, and they may be attached to the deflection yoke 30. FIG. 11 shows such an embodiment.

As shown in FIG. 11, in the present embodiment, the resin frame 39 of the deflection yoke 30, which insulates the horizontal deflection coil 32 from the vertical deflection coil 36 and supports both the deflection coils 32, 36, extends to the neck 13, and the velocity modulation coil 52 and the magnetic substance 54 are attached to an extension portion 39*a* in a cylindrical shape. More specifically, in the embodiment shown in FIG. 11, the velocity modulation coil 52 and the magnetic substance 54 are integrally attached to the deflection yoke 30.

In the present embodiment, the purity magnet 44, the quadrupole magnet 46, and the hexapole magnet 48 constituting the CPU 40 also are attached to the extension portion 39*a* of the resin frame 39. In this respect, in the present embodiment, it can be considered that the CPU 40 and the deflection yoke 30 are provided integrally.

(2) In the embodiment shown in FIG. 11, the velocity modulation coil 52 extends further to the horizontal deflection coil 32 side, compared with the embodiment shown in FIG. 2, whereby the end of the velocity modulation coil 52 on the phosphor screen side protrudes on the phosphor screen side from the end of the shield cup SC on the phosphor screen side. A magnetic flux from a portion, where the velocity modulation coil 52 protrudes, acts on the electron beams without hardly being absorbed by the metal components such as the electrodes and the shield cup SC of the electron gun 16. Therefore, the sensitivity of velocity modulation can be enhanced.

Herein, care should be taken so as not to allow the end of the velocity modulation coil 52 on the phosphor screen side to protrude excessively, i.e., so as not to allow the velocity modulation coil 52 to be too close to the horizontal deflection coil 32. When the velocity modulation coil 52 is too close to the horizontal deflection coil 32, a magnetic field generated by the velocity modulation coil 52 and a magnetic field generated by the horizontal deflection coil 32 interfere with each other excessively to cause so-called ringing in an image on the phosphor screen. In one example, the following was confirmed. If a distance L1 between the end of the velocity modulation coil 52 on the phosphor screen side and the end of the horizontal deflection coil 32 on the electron gun side is set to be 8 mm or more, problematic ringing does not occur.

(3) In the above-mentioned embodiment, the position of the magnetic substance 54 in the tube axis direction is substantially matched with the position of the gap between the G5 electrode and the G6 electrode in the tube axis direction. This is because a main lens is formed in the gap between these two electrodes, and in general (even in this example) the gap between the electrodes forming a main lens is larger than that between any other electrodes. Consequently, a magnetic flux generated by the velocity modulation coil 52 can be concentrated in the wide gap, so that a magnetic flux absorbed by a metal material constituting the electrodes and consumed by an eddy current can be reduced.

However, the position of the magnetic substance 54 in the tube axis direction may be matched with the gap between the other electrodes, instead of the gap between the above-mentioned electrodes. The reason for this is as follows. As long as the magnetic substance 54 is placed so as to correspond to the gap between two electrodes adjacent to each other in the tube axis direction, an eddy current loss is reduced, whereby a magnetic flux can be concentrated in the electron beam passage region.

Furthermore, the number of the magnetic substances need not be one pair. Plural pairs of magnetic substances may be prepared and placed respectively in plural gaps between electrodes. Consequently, the density of a magnetic flux increases over the entire electron beam passage region, so that the sensitivity of velocity modulation can be enhanced further.

(4) In the above-mentioned embodiment, although the magnetic substance 54 is formed in an arc shape, it need not have a complete arc shape. The magnetic substance 54 may have a shape obtained by dividing an annular body of an oval or a polygon (preferably, a polygon of a pentagon or more) into two parts by two cut-away sections. In any case, in order to keep the symmetry of a magnetic flux generated in the neck 13, it is preferable that the magnetic substances 54 are formed so as to be symmetrical with respect to a vertical plane including the tube axis.

(5) In the above-mentioned embodiment, a magnetic substance is a sintered body of magnetic powder of Mg—Zn ferrite. The present invention is not limited thereto, and the magnetic substance may be a sintered body of magnetic powder of Ni—Zn ferrite or Mn—Zn ferrite.

Alternatively, the magnetic substance may be the one formed by mixing any of the above-mentioned magnetic powder in resin, followed by molding, in place of the sintered body. This provides reduced cost, compared with the case of using a sintered body.

(6) In the above-mentioned embodiment, a color cathode-ray tube apparatus has been exemplified. The present invention is not limited thereto, and also is applicable to a monochrome cathode-ray tube such as a projection type cathode-ray tube and a cathode-ray tube apparatus.

The applicable field of the present invention is not particularly limited, and the present invention can be used widely for a TV receiver, a computer display, and the like.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A velocity modulation coil apparatus to be provided on an outer circumferential surface of a funnel of a cathode-ray tube, comprising: a pair of velocity modulation coils for modulating a horizontal deflection velocity of an electron beam emitted from an electron gun, and a pair of magnetic substances, wherein the pair of velocity modulation coils are placed with a horizontal plane, including a tube axis of the cathode-ray tube, interposed therebetween, the pair of magnetic substances are placed with a vertical plane, including the tube axis of the cathode-ray tube, interposed therebetween, the pair of velocity modulation coils includes a straight line portion extending substantially in parallel to the tube axis of the cathode-ray tube, the straight line portion is placed between the pair of magnetic substances and the tube axis of the cathode-ray tube, an interval D between the magnetic substance and the straight line portion is 1 to 3 mm, and assuming that the tube axis of the cathode-ray tube is a Z-axis, a position of an end of the velocity modulation coil on a side opposite to a phosphor screen in a tube axis direction is Z=0, and a position of an end of the velocity modulation coil on a phosphor screen side in the tube axis direction is Z=L, a coordinate $Z_M$ at a center point of the magnetic substance in the tube axis direction satisfies a relationship: $0.2 \times L \leqq Z_M \leqq 0.9 \times L$.

2. The velocity modulation coil apparatus according to claim 1, wherein an angle θ of an open portion between the pair of magnetic substances with respect to the tube axis of the cathode-ray tube is 50° to 90°.

3. The velocity modulation coil apparatus according to claim 1, wherein a length H of the magnetic substance in the tube axis direction is 2 to 5 mm.

4. The velocity modulation coil apparatus according to claim 1, wherein assuming that a length of the magnetic substance in the tube axis direction is H, and a thickness of the magnetic substance along a horizontal axis passing through the tube axis is T, a relationship: $T/H \geqq 1$ is satisfied.

5. The velocity modulation coil apparatus according to claim 1, wherein the magnetic substance is a sintered body of at least one kind of magnetic powder selected from the group consisting of Mg—Zn ferrite, Mn—Zn ferrite, and Ni—Zn ferrite.

6. The velocity modulation coil apparatus according to claim 1, wherein the magnetic substance is made of resin in which at least one kind of magnetic powder selected from the group consisting of Mg—Zn ferrite, Mn—Zn ferrite, and Ni—Zn ferrite is mixed.

7. A cathode-ray tube apparatus, comprising:

a cathode-ray tube including a panel with a phosphor screen formed on an inner surface, a funnel connected to the panel, and an electron gun housed in a neck of the funnel;

a horizontal deflection coil and a vertical deflection coil provided on an outer circumferential surface of the funnel, for deflecting an electron beam emitted from the electron gun in horizontal and vertical directions so as to allow the electron beam to scan the phosphor screen; and a velocity modulation coil apparatus provided art the outer circumferential surface of the funnel, wherein the velocity modulation coil apparatus is the velocity modulation coil apparatus of claim 1.

8. The cathode-ray tube apparatus according to claim 7, wherein the pair of velocity modulation coils are placed on the neck side with respect to the horizontal deflection coil and the vertical deflection coil.

9. The cathode-ray tube apparatus according to claim 7, wherein a position of the pair of magnetic substances in a tube axis direction is matched with a position in the tube axis direction of a gap between two electrodes of the electron gun, which are placed away from each other in the tube axis direction and form a main lens.

* * * * *